US008249468B2

(12) United States Patent
Kuma et al.

(10) Patent No.: US 8,249,468 B2
(45) Date of Patent: Aug. 21, 2012

(54) IMAGE FORMING APPARATUS

(75) Inventors: Kazuosa Kuma, Yokohama (JP); Shinichi Kawahara, Tokyo (JP); Mitsuru Takahashi, Kawasaki (JP); Tsutomu Katoh, Kawasaki (JP); Takeshi Fukao, Yokohama (JP); Kazuhisa Sudo, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 548 days.

(21) Appl. No.: 12/434,009

(22) Filed: May 1, 2009

(65) Prior Publication Data

US 2009/0279906 A1 Nov. 12, 2009

(30) Foreign Application Priority Data

May 9, 2008 (JP) ..... 2008-122967

(51) Int. Cl.
*G03G 15/00* (2006.01)

(52) U.S. Cl. ..... 399/21; 399/66; 399/302; 399/308; 399/388; 399/396

(58) Field of Classification Search ..... 399/10.07, 399/275, 388, 302
See application file for complete search history.

(56) References Cited

U.S. PATENT DOCUMENTS 7,362,993 B2 4/2008 Takahashi
7,941,082 B2 * 5/2011 Kosako et al. ..... 399/301
2005/0008381 A1 * 1/2005 Aono et al. ..... 399/45
2005/0008382 A1 * 1/2005 Taguchi et al. ..... 399/66
2005/0191066 A1 * 9/2005 Yamazaki ..... 399/21
2006/0024094 A1 * 2/2006 Uehara ..... 399/299
2006/0188299 A1 * 8/2006 Matsumoto ..... 399/302
2007/0242971 A1 * 10/2007 Goto ..... 399/82

FOREIGN PATENT DOCUMENTS

JP 2007-106572 4/2007
JP 2008-24507 2/2008

OTHER PUBLICATIONS

U.S. Appl. No. 12/828,612, filed Jul. 1, 2010, Furuya, et al.

* cited by examiner

*Primary Examiner* — Matthew G Marini
(74) *Attorney, Agent, or Firm* — Oblon, Spivak, McClelland, Maier & Neustadt, L.L.P.

(57) ABSTRACT

An image forming apparatus includes at least one image carrier and a recording medium conveyor forming a transfer nip therebetween, a conveyance member disposed closest to the transfer nip on an upstream side of the transfer nip to convey the recording medium to the transfer nip, and a conveyance control mechanism to deactivate the conveyance member to stop providing a conveyance force to the recording medium after the leading edge of the recording medium has entered the transfer nip and before the trailing edge of the recording medium passes a point of force application and remaining in the inactive state until the recording medium passes the point of force application. The conveyance force remains unapplied to the recording medium from when the conveyance control mechanism deactivates the conveyance member to when the trailing edge of the recording medium passes the transfer nip.

15 Claims, 4 Drawing Sheets

IMAGE FORMING APPARATUS

CROSS-REFERENCE TO RELATED APPLICATIONS

The present invention claims priority pursuant to 35 U.S.C. §119 from Japanese Patent Application No. 2008-122967, filed on May 9, 2008 in the Japan Patent Office, the contents and disclosure of which are hereby incorporated by reference herein in their entirety.

BACKGROUND OF THE INVENTION

1. Field of the Invention

Exemplary embodiments of the present invention generally relate to an image forming apparatus, and more particularly, to an image forming apparatus that conveys a recording medium by a conveyance mechanism and transfers an image formed on a surface of an image bearing member onto the recording medium in a nip contact area formed between the image bearing member and a transfer member disposed facing the image bearing member.

2. Discussion of the Related Art

Conventionally, image forming apparatuses incorporate a gate member within a sheet conveyance route extending between a pair of registration rollers and a transfer nip, and a contact/separation mechanism alternately bringing into contact and separating two rollers of the pair of registration rollers, for example.

When forming an image, such image forming apparatuses position a recording medium so that the leading edge thereof can contact the gate member while the registration rollers are separated from each other and before the rollers contact each other. Then, the image forming apparatuses deactivate the gate member to forward the recording medium from the pair of registration rollers to the transfer nip at a given timing. This configuration can minimize the chances of the leading edge of the recording medium from being bent even when the recording medium is being curled.

Further, some known image forming apparatuses include a timing roller disposed downstream from the gate member in a direction of conveyance of the recording medium conveyed by the gate member. After forwarding the recording medium, the pair of registration rollers may be separated from each other again just as the leading edge of the recording medium reaches the timing roller. With image forming apparatuses having this configuration, after the trailing edge of the recording medium has passed the gate member, a subsequent recording medium may contact the gate member expeditiously so as to be ready for a next image forming operation, thereby effectively enhancing or speeding up sequential printing by reducing operating time thereof.

In one related-art image forming apparatus, at least one conveyance mechanism such as a pair of registration rollers and a timing roller is disposed upstream from the transfer nip in a direction of conveyance of the recording medium. In addition, a conveyance speed of the recording medium is generally controlled to be greater in the conveyance mechanism than in the transfer nip.

With this configuration, when one part of the recording medium is held in the transfer nip and another part in the conveyance mechanism, an area between those parts where different parts of the recording medium are sandwiched may deform and bend gradually but increasingly. Then, when passing a point of conveyance force application or a registration point of the conveyance mechanism, the trailing edge of the recording medium, experiencing maximum deformation, may be suddenly released from the sandwiched part and restored to its original shape. This action can cause significant vibration to the trailing edge of the recording medium and further to the recording medium held in the transfer nip, resulting in poor transferability that may give rise to degradation in image quality.

Further, the conveyance mechanism may cause unevenness in conveyance speed with respect to the recording medium due to eccentricity of its own roller. The conveyance mechanism may send the trailing edge of the recording medium toward the transfer nip while an image is being transferred onto the recording medium. With this action, unevenness in conveyance speed caused by the conveyance mechanisms extends to the recording medium that is passing through the transfer nip. This unevenness in conveyance speed can trigger poor transferability, resulting in degradation in image quality.

Conventionally, such degradation in image quality due to unevenness in conveyance speed caused by eccentricity of the conveyance mechanism has not been regarded as a problem. However, in light of increasing market demands for better imaging quality, it is desirable to remedy any degradation in image quality.

SUMMARY OF THE INVENTION

Exemplary aspects of the present invention have been made in view of the above-described circumstances.

Exemplary aspects of the present invention provide an image forming apparatus that can effectively reduce poor transferability caused by conveyance members that are disposed upstream from a transfer nip contact area in a direction of conveyance of a recording medium.

In one exemplary embodiment, an image forming apparatus includes at least one image carrier to carry an image on a surface thereof, a recording medium conveyor disposed at least partly facing a first image carrier of the at least one image carrier to form a transfer nip therebetween, at least one of the first image carrier and the recording medium conveyor conveying a recording medium in the transfer nip for transferring the image formed on the surface of the at least one image carrier onto the recording medium thereat, a conveyance member disposed closest to the transfer nip on an upstream side of the transfer nip in a direction of conveyance of the recording medium to provide a conveyance force to convey the recording medium to the transfer nip, and a conveyance control mechanism located proximal to the conveyance member to control movement of the conveyance member. The conveyance control mechanism shifts the conveyance member to an inactive state to deactivate the conveyance member so that the conveyance member stops providing the conveyance force to move the recording medium after a leading edge of the recording medium has entered the transfer nip and before a trailing edge of the recording medium passes a point of force application where the conveyance member applies the conveyance force to the recording medium, and remains in the inactive state until the recording medium passes the point of force application. The conveyance force remains unapplied to the recording medium at an upstream side of the conveyance member in the direction of conveyance of the recording medium from when the conveyance control mechanism deactivates the conveyance member to when the trailing edge of the recording medium passes the transfer nip.

The conveyance control mechanism may deactivate the conveyance member when a margin provided on the leading edge of the recording medium reaches the transfer nip.

The conveyance member may include two rotary members at least one of which is driven to rotate, and apply the conveyance force to the recording medium by holding the recording medium between the two rotary members. The conveyance control mechanism may deactivate the conveyance member by separating the two rotary members from each other.

The recording medium conveyor may correspond to an electrostatic conveyance belt member to convey the recording medium by electrostatically attracting at least one surface of the recording medium to a surface of the electrostatic conveyance belt member on at least one of an upstream side and a downstream side from the transfer nip in a direction of conveyance of the recording medium.

The conveyance member may convey the recording medium in a substantially vertically upward direction toward the transfer nip.

The above-described image forming apparatus may further include a first image forming part located downstream from the conveyance member and comprising the first image carrier of the at least one image carrier and the recording medium conveyor and forming a single color image to be transferred onto the recording medium at a first transfer nip formed between the first image carrier and the recording medium conveyor while providing the conveyance force to the recording medium, an intermediate transfer member held in contact with the recording medium conveyor to transfer an image onto the recording medium, and a second image forming part disposed downstream from the conveyance member and including multiple second image carriers other than the first image carrier of the at least one image carrier and forming a composite color image on the intermediate transfer member to be transferred onto the recording medium at a second transfer nip formed between the intermediate transfer member and one of the recording medium conveyor and a transfer member other than the recording medium conveyor while providing the conveyance force to the recording medium. The conveyance control mechanism may shift to the inactive state to deactivate the conveyance member so that the conveyance member stops providing the conveyance force to move the recording medium after the leading edge of the recording medium has entered the further-upstream of the first transfer nip and the second transfer nip in the direction of conveyance of the recording medium and before the trailing edge of the recording medium passes the point of force application.

The conveyance control mechanism may shift the conveyance member to the inactive state to deactivate the conveyance member after the leading edge of the recording medium has entered the further-downstream of the first transfer nip and the second transfer nip in the direction of conveyance of the recording medium.

The conveyance control mechanism may shift the conveyance member to the inactive state to deactivate the conveyance member before the leading edge of the recording medium enters the further-downstream of the first transfer nip and the second transfer nip in the direction of conveyance of the recording medium.

An average linear velocity of a part of the recording medium to which the conveyance member applies the conveyance force may be faster than a linear velocity of the image carrier by approximately 0.1% to approximately 2.0%.

The leading edge of the recording medium may contact a surface of the image carrier before entering the transfer nip.

The above-described image forming apparatus may further include a detector to detect whether the trailing edge of the recording medium has passed the point of force application. The conveyance control mechanism may returns the conveyance member to an active state to apply the conveyance force to the recording medium when the detector detects the trailing edge of the recording medium has passed the point of force application.

The above-described image forming apparatus may further include a jam detector to detect a paper jam. The conveyance control mechanism may deactivate the conveyance member when the jam detector detects a paper jam.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
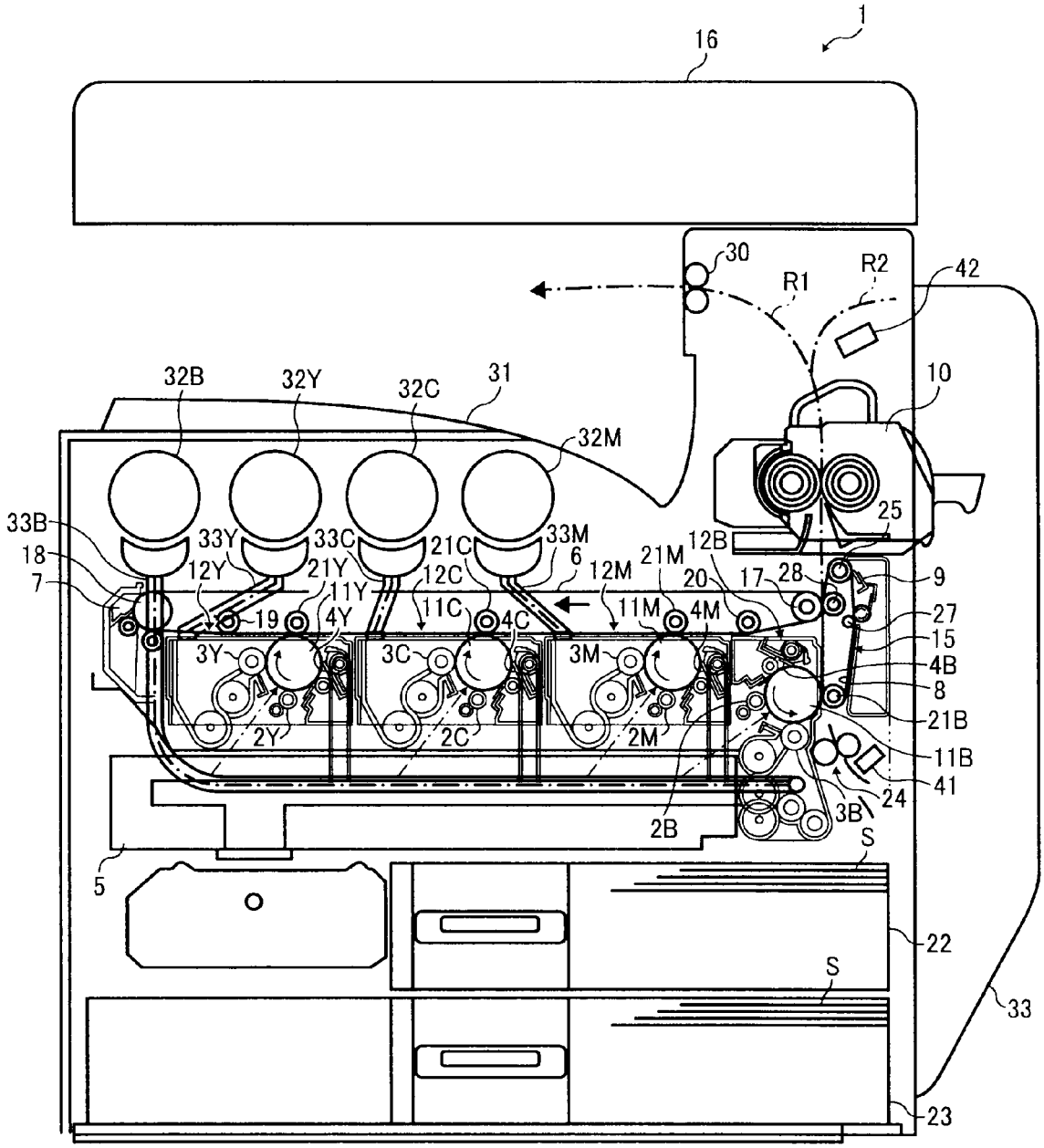
FIG. 1 is a view illustrating a schematic configuration of an image forming apparatus according to an exemplary embodiment of the present invention.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a description is given of a schematic configuration of an image forming apparatus 1 according to an exemplary embodiment of the present invention.

The image forming apparatus 1 can be any of a copier, a printer, a facsimile machine, a plotter, and a multifunction printer including at least one of copying, printing, scanning, plotter, and facsimile functions. In this non-limiting exemplary embodiment, the image forming apparatus 1 functions as a color digital multifunctional machine for electrophotographically forming a toner image based on image data on a recording medium (e.g., a transfer sheet).

Reference symbols "Y", "C", "M", and "B" represent yellow color, cyan color, magenta color, and black color, respectively.

The image forming apparatus 1 includes an intermediate transfer belt 6, a transfer sheet conveyance belt 8, image forming units 12Y, 12C, 12M, and 12B, and a transfer unit 15.

The intermediate transfer belt 6 serves as an intermediate transfer member that rotates in an endless manner. The transfer sheet conveyance belt 8 corresponds to an electrostatic conveyance member that serves as a transfer member. The intermediate transfer belt 6 and the transfer sheet conveyance belt 8 are held in contact with each other and form a secondary transfer nip contact area therebetween.

The transfer unit 15 is located such that the transfer sheet S passes through the secondary transfer nip contact area and the primary transfer nip contact areas in a substantially vertically downward direction.

The image forming units 12Y, 12C, 12M, and 12B serve as process cartridges, each of which is detachably attachable to a main body of the image forming apparatus 1.

The three image forming units 12Y, 12C, and 12M are located along a flat part of an outer circumferential surface of the intermediate transfer belt 6. The image forming unit 12B is located separated from the other three image forming units 12Y, 12C, and 12M. The image forming unit 12B is disposed upstream from the secondary transfer nip contact area in a direction of conveyance of a transfer sheet S and faces the transfer sheet conveyance belt 8.

The image forming units 12Y, 12C, and 12M, and 12B have photoconductors 11Y, 11C, 11M, and 11B, respectively. The photoconductors 11Y, 11C, and 11M serve as image bearing members and are held in contact with the outer circumferential surface of the intermediate transfer belt 6, where respective primary transfer nip contact areas are formed. The photoconductor 11B also serves as an image bearing member and is held in contact with an outer circumferential surface of the transfer sheet conveyance belt 8, where a primary transfer nip contact area is formed. The image forming unit 12B is designed to form a single black toner image directly on a transfer sheet S serving as a recording medium.

Each of the image forming units 12Y, 12C, 12M, and 12B includes a photoconductor 11 (i.e., photoconductors 11Y, 11C, 11M, and 11B) that serves as an image bearing member, a charging unit 2 (i.e., charging units 2Y, 2C, 2M, and 2B), a developing unit 3 (i.e., developing units 3Y, 3C, 3M, and 3B), and a cleaning unit 4 (i.e., cleaning units 4Y, 4C, 4M, and 4B).

The image forming apparatus 1 further includes a toner tank 32 (i.e., toner tanks 32Y, 32C, 32M, and 32B) located above the intermediate transfer belt 6. The toner tanks 32Y, 32C, 32M, and 32B contain yellow toner, cyan toner, magenta toner, and black toner, respectively. The toner tanks 32Y, 32C, 32M, and 32B are connected via toner supply pipes 33Y, 33C, 33M, and 33B, respectively, to the developing units 3Y, 3C, 3M, and 3B, respectively.

Further, the image forming apparatus 1 further includes an optical writing unit 5. The optical writing unit 5 serves as an exposure unit that forms electrostatic latent images corresponding to respective single color toner images by laser light beams on respective surfaces of the photoconductors 11Y, 11C, 11M, and 11B included in the image forming units 12Y, 12C, 12M, and 12B, respectively.

Although the cleaning units 4Y, 4C, 4M, and 4B illustrated herein are generally illustrated as a blade-type units, exemplary embodiments of the present invention are not intended to be limited to this configuration. For example, each of the cleaning units 4Y, 4C, 4M, and 4B of the present invention may have a configuration that includes a fur brush roller, a magnetic brush, or the like, as is generally known in the art.

Further, although the optical writing unit 5 illustrated herein is generally illustrated as a laser-type optical unit, exemplary embodiments of the present invention are not intended to be limited to this configuration. For example, the optical writing unit 5 of the present invention may have a configuration that includes an LED system type, as is generally known in the art.

The image forming apparatus 1 further includes a scanner 16. The scanner 16 reads image data of an original document placed on an image reading glass.

Various image data read by the scanner 16, received by a facsimile machine, or transmitted by a computer are separated to four colors, which are yellow, cyan, magenta, and black. Image data of each color is formed to be transmitted to the optical writing unit 5.

The surfaces of the photoconductors 11Y, 11C, 11M, and 11B are charged uniformly and exposed by respective laser light beams emitted by the optical writing unit 5. The developing units 3Y, 3C, 3M, and 3B hold and convey respective single color toners to develop the corresponding latent images formed on the photoconductors 11Y, 11C, 11M, and 11B to respective single color toner images. The color toner images formed on the photoconductors 11Y, 11C, and 11M are overlaid or superimposed one after another on the intermediate transfer belt 6 according to respective given timings. This action is referred to as primary transfer. The primary transfer forms a three-color toner image on the intermediate transfer belt 6.

The intermediate transfer belt 6 is spanned around and extendedly supported by a drive roller 17, a driven roller 18, and tension rollers 19 and 20. Primary transfer rollers 21Y, 21C, and 21M, which serve as primary transfer members, are held in contact with an inner surface of a loop of the intermediate transfer belt 6 and are disposed facing the photoconductors 11Y, 11C, and 11M by sandwiching the intermediate transfer belt 6. A belt cleaning unit 7 serves as a belt cleaning member for removing residual toner from the intermediate transfer belt 6 and is disposed on the outer circumferential surface thereof, at a position facing the driven roller 18.

The transfer unit 15 includes the transfer sheet conveyance belt 8, a drive roller 25, a primary transfer roller or driven roller 21B, a tension roller 27, a secondary transfer roller 28, and a belt cleaning unit 9.

The transfer sheet conveyance belt 8 is spanned around and extendedly supported by the primary transfer roller 21B, the drive roller 25, the tension roller 27, and the secondary transfer roller 28.

The drive roller 25 supports the transfer sheet conveyance belt 8, as described above. The driven roller 21B also functions as the primary transfer roller for transferring black color toner onto the transfer sheet S. The belt cleaning unit 9 serves as a cleaning unit for cleaning the surface of the transfer sheet conveyance belt 8.

The secondary transfer roller 28 forms the secondary transfer nip contact area, as previously described, and is disposed facing the drive roller 17 supporting the intermediate transfer belt 6. The secondary transfer roller 28 can change its position by a separation/contact mechanism, not shown. With this separation/contact mechanism for the secondary transfer roller 28, the transfer sheet conveyance belt 8 can be separated from and contact to the intermediate transfer belt 6.

A black toner image is formed on the photoconductor 11B, and is then transferred directly onto the transfer sheet S at the primary transfer nip contact area formed between the photoconductor 11B and the primary transfer roller 21B. The transfer sheet S is electrostatically held on an outer circumferential surface of the transfer sheet conveyance belt 8.

As the surface of the transfer sheet conveyance belt 8 moves, the transfer sheet S having the black toner image thereon is conveyed to the secondary transfer nip contact area formed between the intermediate transfer belt 6 and the secondary transfer roller 28. The three-color toner image formed on the intermediate transfer belt 6 and the black toner image formed on the transfer sheet S are overlaid to form a four-color toner image.

Although the transfer sheet conveyance belt 8 commonly serves as a transfer member that forms the secondary transfer nip contact area and a transfer member that forms the primary transfer nip contact area for black color toner, the exemplary embodiments of the present invention are not intended to be limited to this configuration. For example, the transfer member forming the secondary transfer nip contact area and the transfer member forming the primary transfer nip contact area for black color toner of the present invention can be different members. Further, the transfer member of the present invention is not limited to a belt member but may include a roller member.

Sheet feeding trays 22 and 23 are disposed below the main body of the image forming apparatus 1 to accommodate transfer sheets S. Each transfer sheet S is fed by a sheet feed unit, not shown, from one of the sheet feeding trays 22 and 23 and is conveyed by a transfer member, not shown, to a pair of registration rollers 24 that serves as a conveyance member. While being conveyed, the leading edge of the transfer sheet S contacts the pair of registration rollers 24, so that skew of the transfer sheet S can be adjusted. Then, the pair of registration rollers 24 is driven at a given timing to convey the transfer sheet S toward the primary transfer nip contact area for a black toner image.

After passing through the primary transfer nip contact areas and the secondary transfer nip contact area, the transfer sheet having the four-color toner image thereon is conveyed to a fixing unit 10 so as to have the four-color toner image fixed to the transfer sheet S. By so doing, a full-color toner image is formed on the transfer sheet S.

In a single side mode, the fixed transfer sheet S is conveyed along a conveyance route R1 and discharged by a pair of discharging rollers 30 to a sheet discharging tray 31 in a face-down manner and stacked therein.

In a duplex side mode, the transfer sheet S with a full-color image on one side thereof is guided by a separator, not shown, to a conveyance route R2, reversed in a duplex print unit 33, and conveyed toward the pair of registration rollers 24 again. Then, the above-described operations are repeated to form an image on the other side of the transfer sheet S.

Further, the image forming apparatus 1 includes first and second optical sensors 41 and 42, which will be described later.

Figure 2:
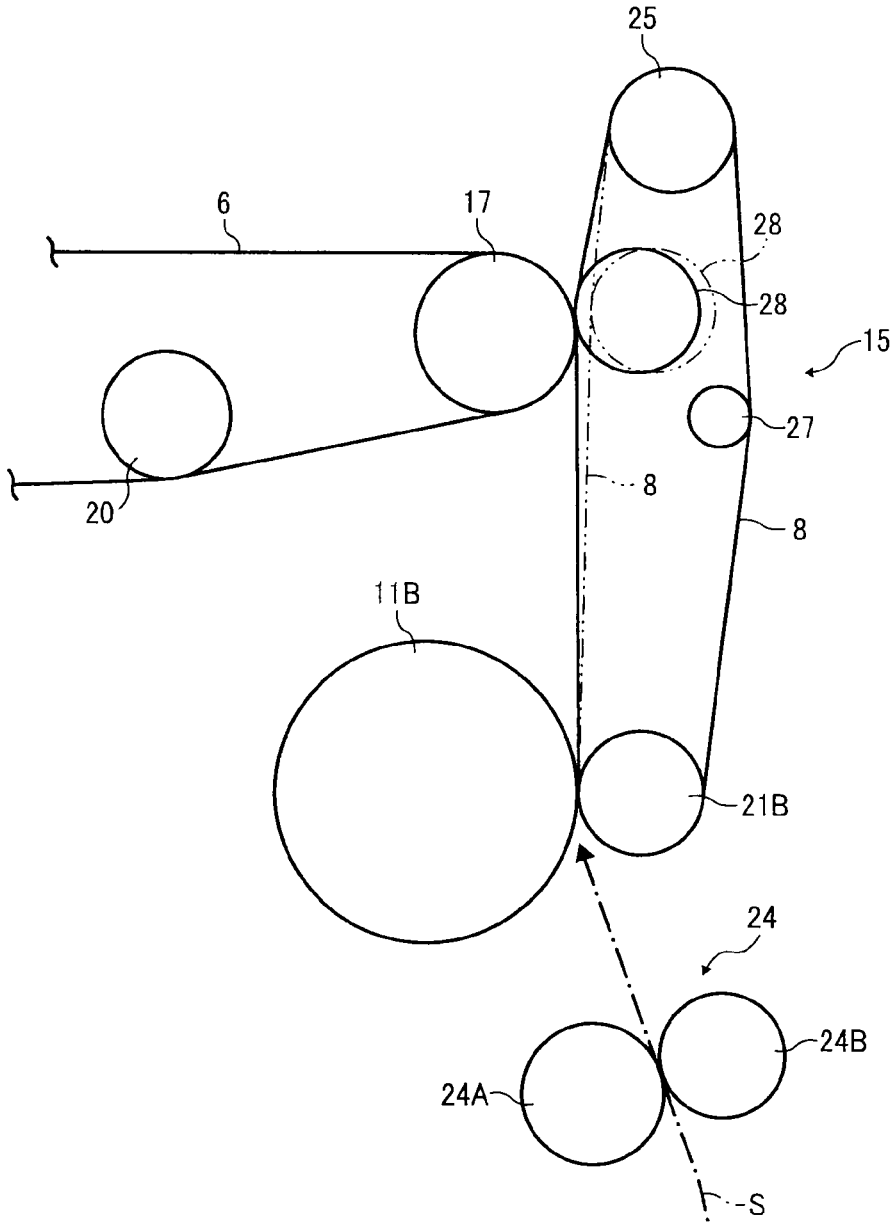
FIG. 2 is a view illustrating a schematic configuration of a contact/separation mechanism of a secondary transfer roller.

Referring to FIG. 2, a description is given of a schematic structure of the transfer unit 15 including the secondary transfer roller 28, explaining separation and contact operations.

The transfer sheet S is conveyed between the pair of registration rollers 24 that includes a first roller 24A and a second roller 24B and enters the first transfer nip contact area formed between the photoconductor 11B and the primary transfer roller 21B, as indicated by a chain line in FIG. 2.

As indicated by a solid line, the transfer sheet conveyance belt 8 is deformed to contact with the intermediate transfer belt 6 for forming the secondary transfer nip contact area when developing a full-color toner image by superimposing a composite color toner image and a black toner image thereat. On the other hand, as indicated by a broken line or a two dot chain line, when forming a monochrome image, the secondary transfer roller 28 changes its position so that the transfer sheet conveyance belt 8 can be separated from the intermediate transfer belt 6. In the monochrome print mode, only the image forming unit 12B for black color toner is used for image forming. That is, the image forming units 12Y, 12C, and 12M and the intermediate transfer belt 6 are not used. The transfer sheet S with a black toner image thereon is conveyed to the fixing unit 10 without contacting the intermediate transfer belt 6, producing in a monochrome image. As previously described, the image forming units 12Y, 12C, and 12M and the intermediate transfer belt 6 are not operated, which can use the parts and units over an extended period of time.

Although the secondary transfer roller 28 illustrated herein is generally deformable or can change its position, exemplary embodiments of the present invention are not limited to this configuration. For example, the secondary transfer roller 28 can have a configuration in which the overall transfer sheet conveyance belt 8 is rotated about the driven roller 21B so as to separate the transfer sheet conveyance belt 8 from the intermediate transfer belt 6.

Alternatively, the secondary transfer roller 28 can have a configuration in which the drive roller 17 that supports the intermediate transfer belt 6 is changed by a not-illustrated unit so as to separate the intermediate transfer belt 6 from the transfer sheet conveyance belt 8. In this case, since the shape or form of a transfer sheet S in conveyance does not change, the movement of the transfer sheet S along the conveyance route from the transfer sheet conveyance belt 8 to the fixing unit 10 can be stable. Therefore, the transfer sheet S after being discharged from the fixing unit 10 can be prevented from having wrinkle thereon and/or skew or distortion of the image formed thereon.

Further, the black toner collected by the cleaning unit 4B according to the exemplary embodiments of the present invention is conveyed to the developing unit 3B along a black toner collection route, not shown, and is recycled. In the exemplary embodiments of the present invention, a color toner other than black toner does not adhere to the photoconductor 11B of the image forming unit 12B for black toner image due to reverse transfer, for example. Therefore, color toners other than black toner cannot be mixed with the black toner collected by the cleaning unit 4B. Alternatively, a sheet powder removing unit or a switching unit for switching a direction of toner to a route for toner discharging can be provided in the middle of the black toner collection route.

Any suitable toner can be employed with magnetic carriers as two-component developer in the present invention. In this case, preferable toner density includes approximately 1 part by weight to approximately 10 parts by weight of toner to approximately 100 parts by weight of carrier. Further, the toner used for the present invention can be either magnetic for one-component developer or non-magnetic for two-component developer.

Further, the photoconductor 11 (i.e., the photoconductors 11Y, 11C, 11M, and 11B) and at least one of the charging unit 2 (i.e., the charging units 2Y, 2C, 2M, and 2B), the developing unit 3 (i.e., the developing units 3Y, 3C, 3M, and 3B), and the cleaning unit 4 (i.e., the cleaning units 4Y, 4C, 4M, and 4B) are integrally mounted on a process cartridge, which corresponds to the image forming unit 12 (i.e., the image forming units 12Y, 12C, 12M, and 12B). Since the process cartridge is detachably attachable to the image forming apparatus 1, the process cartridge can be replaced easily at maintenance, which can enhance the convenience of the image forming apparatus 1.

Figure 3A:
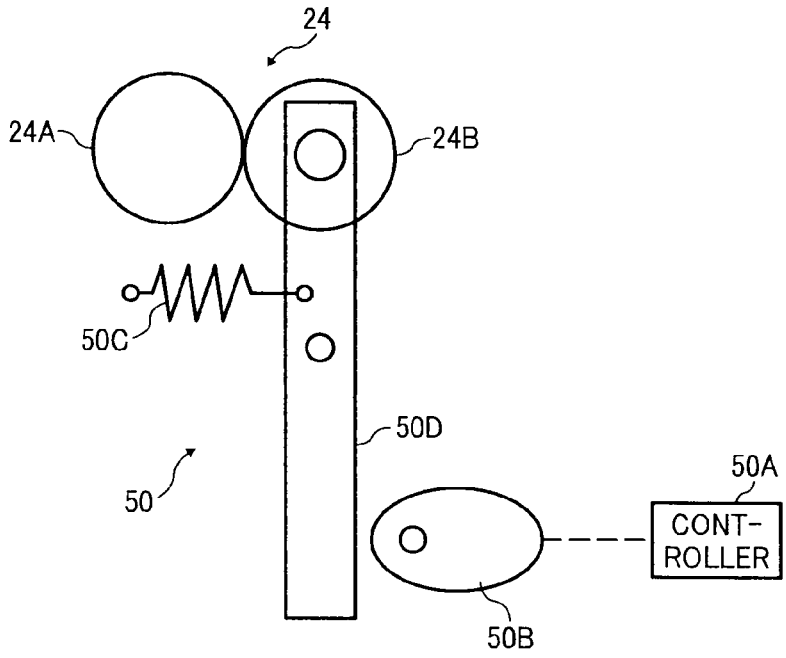
FIG. 3A is a view illustrating a schematic configuration of a contact/separation mechanism for controlling movement of a pair of registration rollers with the rollers held in contact with each other.
Figure 3B:
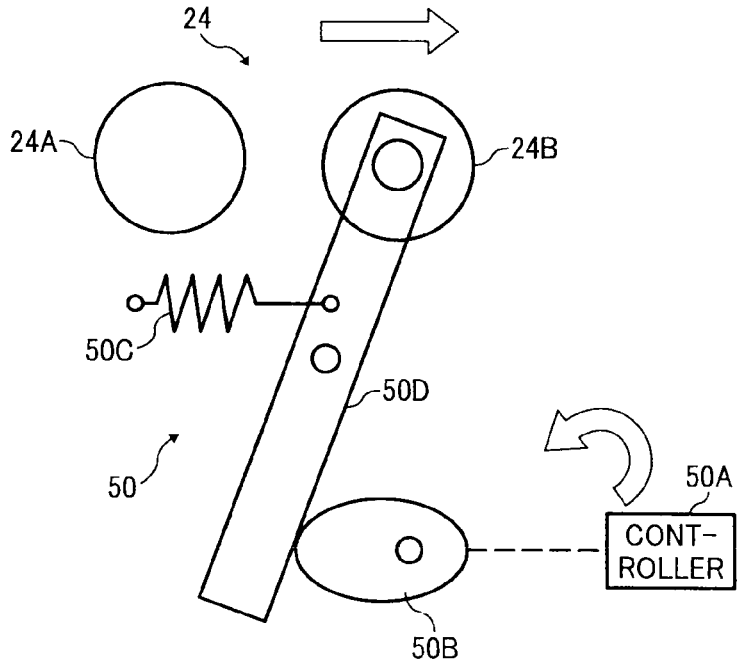
FIG. 3B is a view illustrating a schematic configuration of the contact/separation mechanism of FIG. 3A, with the pair of registration rollers separated from each other.

Referring now to FIGS. 3A and 3B, a detailed description is given of a contact/separation mechanism 50 for controlling movements of the pair of registration rollers 24 according to an exemplary embodiment of the present invention.

FIG. 3A illustrates a schematic configuration of the contact/separation mechanism 50 when a first roller 24A and a second roller 24B of the pair of registration rollers 24 are held in contact with each other. FIG. 3B illustrates a schematic configuration of the contact/separation mechanism 50 when the first roller 24A and the second roller 24B of the pair of registration rollers 24 are separated from each other.

The contact/separation mechanism 50 serves as a conveyance control mechanism to control the movement of the pair of registration rollers 24. The contact/separation mechanism 50 includes a controller 50A, an eccentric cam 50B, a spring 50C, and an arm 50D.

The contact/separation mechanism 50 controls the first roller 24A fixedly disposed to the main body of the image forming apparatus 1. The first roller 24A is connected to a drive unit, not shown, to rotate at a predetermined time. By contrast, the second roller 24B is disposed movable in a given range with respect to the first roller 24A and rotates with the first roller 24A when they are held in contact. A rotary shaft of the second roller 24B is rotatably mounted on one end of the arm 50D. The arm 50D is supported to rotate about a substantially center part thereof. The spring 50C serves as a biasing member, and one end thereof is attached to the arm 50D. The spring 50C biases the second roller 24B via the arm 50D such that the second roller 24B moves toward the first roller 24A as the arm 50D rotates.

The eccentric cam 50B is rotated by a drive source, not shown, and is connected to the controller 50A. As shown in FIG. 3A, when a surface of the eccentric cam 50B does not contact the other end of the arm 50D, which is an end portion opposite the end on which the rotary shaft of the second roller 24B is mounted, the first roller 24A and the second roller 24B are held in contact with each other by a biasing force of the spring 50C. As the first roller 24A rotates, the pair of registration rollers 24 generates a conveyance force to the transfer sheet S that is held between the first roller 24A and the second roller 24B to convey the transfer sheet S in a forward direction.

By contrast, as shown in FIG. 3B, when the eccentric cam 50B rotates for half rotation as indicated by arrow in FIG. 3B while the first roller 24A and the second roller 24B are held in contact with each other, the surface of the eccentric cam 50B contacts the other end of the arm 50D to rotate the arm 50D in a direction against the biasing force of the spring 50C. According to the above-described action, the first roller 24A and the second roller 24B may be separated from each other in a direction indicated by arrow in FIG. 3B, and as a result, the pair of registration rollers 24 is released from the conveyance force or shifts to the inactive state so as not to provide the conveyance force to the transfer sheet S.

Such a method for switching the pair of registration rollers 24 between an active state and the inactive state is not limited to the above-described method performed by the contact/separation mechanism 50. For example, exemplary embodiments of the present invention can have a configuration in which both of the first roller 24A and the second roller 24B of the pair of registration rollers 24 are fixedly disposed to the main body of the image forming apparatus 1 and at least one of which is connected to a drive source. A clutch is disposed between the drive source and at least one of the first and second rollers 24A and 24B. The clutch can be controlled such that a driving force generated by the drive source is transmitted to the pair of registration rollers 24 when activating the pair of registration rollers 24 and such that the driving force is not transmitted when deactivating the pair of registration rollers 24. When the pair of registration rollers 24 is in the inactive state, the first roller 24A and the second roller 24B of the pair of registration rollers 24 are not driven to rotate, and therefore the conveyance force is not provided from the pair of registration rollers 24 to the transfer sheet S.

Figure 4:
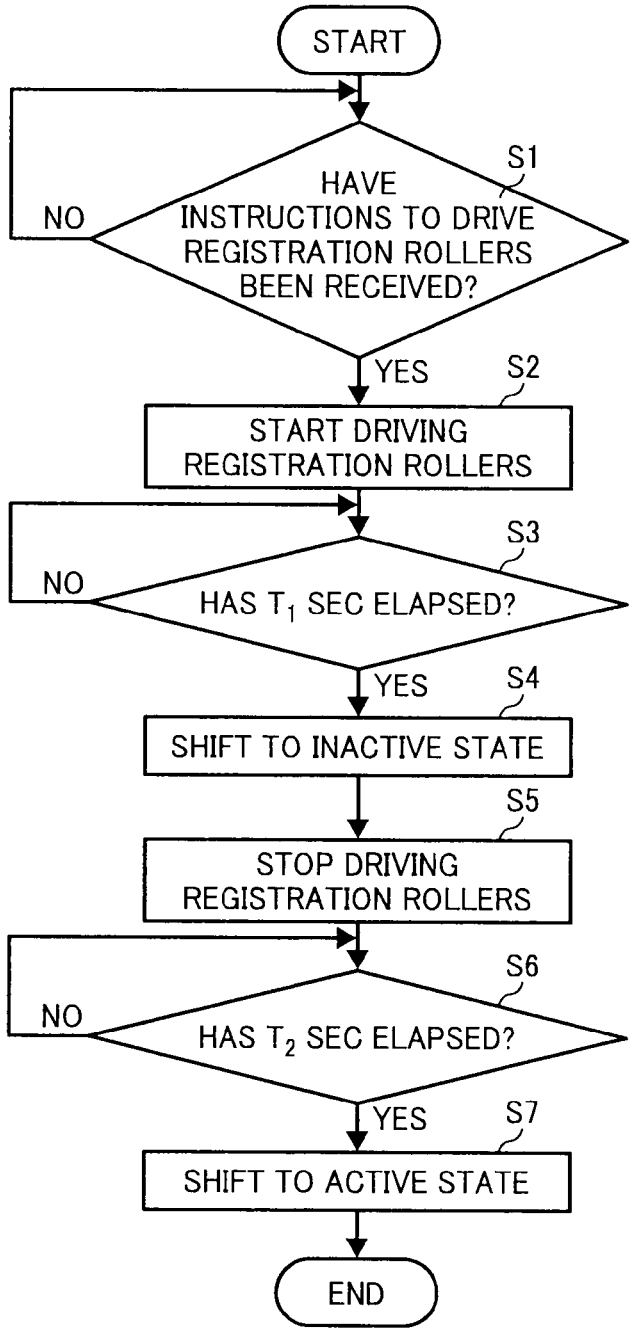
FIG. 4 is a flowchart showing a control flow of the contact/separation mechanism of FIGS. 3A and 3B.

Referring to a flowchart illustrated in FIG. 4, a description is given of a control flow of the contact/separation mechanism 50 controlling the movement of the pair of registration rollers 24. Although the following description is given as an example for forming a color image, the description is substantially same for forming a monochrome image.

As previously described, the contact/separation mechanism 50 includes the controller 50A that controls the movement of the pair of registration rollers 24.

When the leading edge of the transfer sheet S is conveyed to the pair of registration rollers 24 that is in the active state, instructions to drive the pair of registration rollers 24 is sent.

In step S1, the controller 50A of the contact/separation mechanism 50 determines whether the instructions to drive the pair of registration rollers 24 have been received. When the instruction has not been received, the process is repeated until the controller receives the instruction. When the instruction has been received in step S1, the controller 50A starts to drive the drive source connected to the first roller 24A of the pair of registration rollers 24 in step S2. Thus, the drive source can transmit the conveyance force to the transfer sheet S to feed the transfer sheet S to the primary transfer nip contact area. In this exemplary embodiment, the leading edge of the transfer sheet S contacts not to the surface of the transfer sheet conveyance belt 8 but to the surface of the photoconductor 11B before entering the primary transfer nip contact area. This action can fill a gap that can be formed between the transfer sheet S and the photoconductor 11B at the entrance of the primary transfer nip contact area, thereby preventing flapping of the leading edge of the transfer sheet S to obtain better transferability.

The leading edge of the transfer sheet S conveyed by the pair of registration rollers 24 has a non-image forming region or a margin that is a region determined not to form any image thereon (hereinafter referred to as a "margin on the leading edge"). After the leading edge of the transfer sheet S has entered the primary transfer nip contact area, a leading edge of a black toner image formed on the photoconductor 11B of the image forming unit 12B may reach the primary transfer nip contact area when a trailing end of the margin on the leading edge of the transfer sheet S. Thus, the black toner image may be transferred in an image forming region that follows the margin on the leading edge of the transfer sheet S at the primary transfer nip contact area.

After step S2, the controller 50A of the contact/separation mechanism 50 according to an exemplary embodiment of the present invention determines whether a $T_1$ second has elapsed after receiving the instructions to start driving the pair of registration rollers 24 in step S3. When the $T_1$ second has not elapsed, the process is repeatedly executed until the $T_1$ second elapses. When the $T_1$ second has elapsed, the controller 50A drives the drive source of the contact/separation mechanism 50 to move the eccentric cam 50B by half rotation so as to deactivate the pair of registration rollers 24 in step S4, and stops the movement of the pair of registration rollers 24 in step S5. With the above-described actions, in this exemplary embodiment of the present invention, the pair of registration rollers 24 can be deactivated after the leading edge of the transfer sheet S has entered the primary transfer nip contact area and before the trailing end of the margin on the leading edge of the transfer sheet S passes through the primary transfer nip contact area. That is, the pair of registration rollers 24 can be deactivated when the margin on the leading edge of the transfer sheet S remains in the primary transfer nip contact area.

After step S5, the controller 50A of the contact/separation mechanism 50 according to an exemplary embodiment of the present invention determines whether a $T_2$ second has elapsed after receiving the instructions to start driving the pair of registration rollers 24 in step S6. In this case, a relation of "$T_2>T_1$" is satisfied. When the $T_2$ second has not elapsed, the process is repeatedly executed until the $T_2$ second elapses. When the $T_2$ second has elapsed, the controller 50A drives the drive source of the contact/separation mechanism 50 to move the eccentric cam 50B by half rotation so as to cause the pair of registration rollers 24 to move or return to the active state in step S7. With the above-described actions, in this exemplary embodiment of the present invention, the pair of registration rollers 24 can be activated again at a predetermined time after the trailing edge of the transfer sheet S has passed by a conveyance force applying point, which corresponds to a registration point, of the pair of registration rollers 24.

In an exemplary embodiment of the present invention, when the pair of registration rollers 24 is deactivated or is moved to the inactive state, the conveyance force is applied to the transfer sheet S only by the photoconductor 11B and the transfer sheet conveyance belt 8 within the primary transfer nip contact area. That is, the conveyance force is applied to the transfer sheet S by neither the pair of registration rollers 24 nor other conveyance members or mechanisms disposed upstream from the pair of registration rollers 24 in a direction of conveyance of the transfer sheet S. Further, until the trailing edge of the transfer sheet S passes through the primary transfer nip contact area, the conveyance force to the transfer sheet S may not be applied by any member except the photoconductor 11B and the transfer sheet conveyance belt 8 that form the primary transfer nip contact area for the transfer sheet S located in an upstream side from the primary transfer nip contact area in the direction of conveyance of the transfer sheet S. Therefore, while the black toner image is being transferred onto the transfer sheet S at the primary transfer nip contact area, the conveyance members such as the pair of registration rollers 24 disposed upstream from the primary transfer nip contact area may not cause unevenness in conveyance speed due to eccentricity of rollers, etc. to the transfer sheet S. As a result, poor transferability of the black toner image may not occur due to the unevenness in conveyance speed.

Further, in an exemplary embodiment of the present invention, while the three-color toner image is transferred onto the transfer sheet S at the secondary transfer nip contact area, the conveyance member including the pair of registration rollers 24 disposed upstream from the primary transfer nip contact area may not cause unevenness in conveyance speed due to eccentricity of rollers, etc. to the transfer sheet S. As a result, poor transferability of the three-color toner image may not occur due to the unevenness in conveyance speed.

Further, in this exemplary embodiment of the present invention, the pair of registration rollers 24 moves to the inactive state before the trailing edge of the transfer sheet S passes through a registration position. That is, before the transfer sheet S experiences its maximum deformation between the primary transfer nip contact area and the pair of registration rollers 24, the transfer sheet S may be restored to its original shape. Therefore, when the pair of registration rollers 24 is switched to the inactive state, amounts of vibration or oscillation to be transmitted to the primary transfer nip contact areas and the secondary transfer nip contact area can be significantly reduced than amounts of those transmitted to a transfer nip contact area in a conventional image forming apparatus when the trailing edge of a transfer sheet passes through the pair of registration rollers 24.

Further, in this exemplary embodiment of the present invention, the pair of registration rollers 24 is in the inactive state when the trailing edge of the transfer sheet S passes through the registration position. The transfer sheet S remaining between the primary transfer nip contact area and the pair of registration rollers 24 has an amount of deformation smaller than that in the conventional image forming apparatus. Therefore, the amount of vibration or oscillation to be transmitted to the primary transfer nip contact area and the secondary transfer nip contact area when the trailing edge of the transfer sheet S passes through the registration position can be made significantly smaller than that in the conventional image forming apparatus. As a result, the configuration according to this exemplary embodiment of the present invention can significantly reduce poor transferability caused by vibration generated due to the above-described movement of the transfer sheet S, thereby achieving higher image quality than the conventional image forming apparatus.

Further, the image forming apparatus 1 according to this exemplary embodiment of the present invention includes first and second optical sensors 41 and 42, as shown in FIG. 1, each of which serving as a detector.

As shown in FIG. 1, the first optical sensor 41 is disposed proximal to an upstream side in a direction of conveyance of the transfer sheet 24 by the pair of registration rollers 24. Detection results obtained by the first optical sensor 41 are transmitted to the controller of the contact/separation mechanism 50. In this exemplary embodiment, if the first sensor 41 does not detect the transfer sheet S within a given period of time after the controller has caused the transfer sheet S to be fed from one of the sheet feeding trays 22 and 23, the controller determines that a paper jam in misfeeding paper or a paper misfeeding has occurred, and then terminates the image forming operation.

Also, as shown in FIG. 1, the second optical sensor 42 is disposed proximal to and downstream from the fixing unit 10 in a direction of conveyance of the transfer sheet S. Detection results obtained by the second optical sensor 42 are transmitted to the controller of the contact/separation mechanism 50. In this exemplary embodiment, if the second sensor 42 does not detect the transfer sheet S within a given period of time after the first sensor 41 has detected the transfer sheet S, the controller determines that a paper jam in the image forming apparatus 1 or a paper jam inside has occurred, and then terminates the image forming operation.

In this exemplary embodiment, when the first and second sensors 41 and 42 have detected the paper misfeeding and/or the paper jam inside, the controller sends instructions to the contact/separation mechanism 50 to release the pair of registration rollers 24 so that the paper jam can be solved easily.

As described above, the image forming apparatus 1 according to an exemplary embodiment of the present invention includes the photoconductor 11B that serves as a first carrier of at least one image carrier to carry an image on a surface thereof and the transfer sheet conveyance belt 8 that serves as a recording medium conveyor disposed at least partly facing the photoconductor 11B to form the primary transfer nip contact area therebetween. The photoconductor 11B and the transfer sheet conveyance belt 8 convey the transfer sheet S in the primary transfer nip contact area for transferring the image formed on the surface of the photoconductor 11B onto the transfer sheet S at the primary transfer nip contact area. The image forming apparatus 1 according to an exemplary embodiment of the present invention further includes the pair of registration rollers 24 that serves as a conveyance member disposed closest to the primary transfer nip contact area on an upstream side of the primary transfer nip contact area in a direction of conveyance of the transfer sheet S to provide a conveyance force to convey the transfer sheet S to the primary transfer nip contact area, and the contact/separation mechanism 50 that serves as a conveyance control mechanism located proximal to the pair of registration rollers 24 to control movement of the pair of registration rollers 24. The contact/separation mechanism 50 shifts the pair of registration rollers 24 to an inactive state to deactivate pair of registration rollers 24 so that the pair of registration rollers 24 stops providing the conveyance force to move the transfer sheet S after the leading edge of the transfer sheet S has entered the primary transfer nip contact area and before the trailing edge of the transfer sheet S passes the point of force application or the registration point where the pair of registration rollers 24 applies the conveyance force to the transfer sheet S, and remains in the inactive state until the transfer sheet S passes the point of force application. The conveyance force remains unapplied to the transfer sheet S at an upstream side of the pair of registration rollers 24 in the direction of conveyance of the transfer sheet S from when the contact/separation mechanism 50 deactivates the pair of registration rollers 24 to when the trailing edge of the transfer sheet S passes the primary transfer nip contact area. As previously described, the above-described configuration can prevent poor transferability in the primary transfer nip contact area, thereby obtaining better image quality as compared with a configuration of prior art.

Specifically in this exemplary embodiment of the present invention, the contact/separation mechanism 50 deactivates the pair of registration rollers 24 when a margin provided on the leading edge of the transfer sheet S reaches the primary transfer nip contact area. Since the contact/separation mechanism 50 according to an exemplary embodiment of the present invention controls the movement of the pair of registration rollers 24 to cause the pair of registration rollers 24 to shift to the inactive state or the active state. Conventionally it is likely that, with such a configuration of prior art, vibration occurs when the pair of registration rollers 24 shifts from the active state to the inactive state and the vibration extends to the secondary transfer nip contact area and/or the primary transfer nip contact area. However, with the above-described configuration according to this exemplary embodiment of the present invention, even when the vibration extends to the secondary transfer nip contact area and/or the primary transfer nip contact area, an image is not yet formed at that time. Therefore, the configuration according to this exemplary embodiment of the present invention may not be affected by such vibration and can obtain good transferability.

Further in this exemplary embodiment of the present invention, the pair of registration rollers 24 includes the first roller 24A and the second roller 24B serving as two rotary members at least one of which is driven to rotate, and applies the conveyance force to the transfer sheet S by holding the transfer sheet S between the first roller 24A and the second roller 24B. The contact/separation mechanism 50 deactivates the pair of registration rollers 24 by separating the first roller 24A and the second roller 24B from each other. Accordingly, this exemplary embodiment of the present invention can achieve a relatively simple configuration for switching the active state and the inactive state of the pair of registration rollers 24.

Further in this exemplary embodiment of the present invention, the transfer sheet conveyance belt 8 corresponds to an electrostatic conveyance belt member to convey the transfer sheet S by electrostatically attracting at least one surface of the transfer sheet S to a surface of the electrostatic conveyance belt member on at least one of the upstream side and the downstream side from the primary transfer nip contact area in a direction of conveyance of the transfer sheet S. In this exemplary embodiment of the present invention, since the transfer sheet S may need to be conveyed only by the conveyance force applied in the primary transfer nip contact area after the pair of registration rollers 24 has been deactivated, it is required to secure a sufficient conveyance force. If a generally known roller is used as a transfer member or a recording medium conveyor, a contact area or a transfer nip contact area formed between the known roller and an image carrier may need to provide a large amount of conveyance force only by itself. To obtain a sufficient amount of conveyance force, a pressure at the transfer nip needs to be increased. However, an increase in pressure of the transfer nip may give rise to poor transferability easily, which can result in deterioration in image quality. By contrast, according to this exemplary embodiment of the present invention, at least one surface of the transfer sheet S other than the transfer nip contact area is electrically attracted to the surface of the transfer sheet conveyance belt 8, and the conveyance force can be applied by the at least one surface of the transfer sheet S. Therefore, a sufficient amount of conveyance force can be secured even if the pressure of the transfer nip is less increased as compared with the configuration employing the known roller. Accordingly, this exemplary embodiment of the present invention can easily obtain a sufficient conveyance force and good transferability.

Further in this exemplary embodiment of the present invention, the pair of registration rollers 24 conveys the transfer sheet S in a substantially vertically upward direction toward the primary transfer nip contact area. Generally, such a configuration has different settings in optimal registration linear velocity to the photoconductor 11B. That is, when the transfer sheet S has two types, thin paper and thick paper, it is desirable that the setting of a registration linear velocity for thin paper is faster than the setting of a registration linear velocity for thick paper. However, if the setting of a registration linear velocity is set suitable for thin paper, when thick paper is used, a pressing force of the transfer sheet S to the primary transfer nip contact area becomes excessively great, which can cause an impact when the leading edge of the transfer sheet S enters the primary transfer nip contact area. The impact can vibrate the transfer sheet S on a part sandwiched between the primary transfer nip contact area and the pair of registration rollers 24, and cause poor transferability to further lead to degradation in image quality. On the other hand, if the setting of a registration linear velocity is set suitable for thick paper, stable conveyance cannot be achieved when conveying a thin paper. According to this exemplary embodiment of the present invention, such vibration can be eliminated by deactivating the pair of registration rollers 24. After the movement of the pair of registration rollers 24 has shifted to the inactive state, poor transferability due to impact caused when the leading edge of the transfer sheet S enters the primary transfer nip contact area can be minimized or prevented.

Further, the image forming apparatus 1 according to this exemplary embodiment of the present invention includes multiple image forming units 12Y, 12C, 12M, and 12B and the intermediate transfer belt 6. The image forming unit 12B serves as the first image forming part located downstream from the pair of registration rollers 24 and includes the photoconductor 11B for black toner image of the four photoconductors 11 (i.e., the photoconductors 11Y, 11C, 11M, and 11B) and the transfer sheet conveyance belt 8. The image forming unit 12B forms a single black color image to be transferred onto the transfer sheet S at the primary transfer nip contact area formed between the photoconductor 11B and the transfer sheet conveyance belt 8 while providing the conveyance force to the transfer sheet S. The intermediate transfer belt 6 serves as an intermediate transfer member and is held in contact with the transfer sheet S to transfer a composite image formed on the photoconductors 11Y, 11C, and 11M onto the transfer sheet S. The image forming units 12Y, 12C, and 12M serve as a second image forming part disposed downstream from the pair of registration rollers 24 and include the photoconductors 11Y, 11C, and 11M serving as multiple second image carriers other than the photoconductor 11B. As previously described, the image forming units 12Y, 12C, and 12M form the composite color image on the intermediate transfer belt 6 to transfer the composite color image onto the transfer sheet S at the secondary transfer nip contact area formed between the intermediate transfer belt 6 and one of the transfer sheet conveyance belt 8 and a transfer member other than the transfer sheet conveyance belt 8 while providing the conveyance force to the transfer sheet S. At the secondary transfer nip contact area the composite color image and the single black color image are superimposed to form a four-color toner image. The contact/separation mechanism 50 shifts the pair of registration rollers 24 to the inactive state to deactivate the pair of registration rollers 24 so that the pair of registration rollers 24 stops providing the conveyance force to move the transfer sheet S after the leading edge of the transfer sheet S has entered the further-upstream of the primary transfer nip contact area and the secondary transfer nip contact area in the direction of conveyance of the transfer sheet S and before the trailing edge of the transfer sheet S passes the point of force application. In the image forming apparatus 1 having the above-described configuration, it is unlikely that color toner other than black toner may easily be mixed with the collected black toner, and therefore black toner can easily be reused.

Specifically in the above-described configuration of the image forming apparatus 1 according to this exemplary embodiment of the present invention, the contact/separation mechanism 50 may shift the movement of the pair of registration rollers 24 to the inactive state to deactivate the pair of registration rollers 24 after the leading edge of the transfer sheet S has entered the further-downstream of the primary transfer nip contact area and the secondary transfer nip contact area in the direction of conveyance of the transfer sheet S. In this case, when the pair of registration rollers 24 is switched to the inactive state, the transfer sheet S receives the conveyance force from at least two areas, which are the primary transfer nip contact area and the secondary transfer nip contact area. Therefore, even when a roller member is employed instead of the electrostatic conveyance belt, the transfer sheet can be conveyed stably with a relatively small transfer nip pressure.

As a matter of course, the pair of registration rollers 24 can be deactivated and stop applying the conveyance force before the leading edge of the transfer sheet S enters the secondary transfer nip contact area. In this case, since the pair of registration rollers 24 remains inactive when the leading edge of the transfer sheet S enters the secondary transfer nip contact area, misregistration between the black toner image transferred at the primary transfer nip contact area and the composite color image transferred at the secondary transfer nip contact area can be prevented.

Further in this exemplary embodiment of the present invention, the average linear velocity of a part of the transfer sheet S to which the pair of registration rollers 24 applies the conveyance force is faster than a linear velocity of the photoconductor 11B by approximately 0.1% to approximately 2.0%. Therefore, even if the pair of registration rollers 24 moves to the inactive state immediately after the leading edge of the transfer sheet S has entered the primary transfer nip contact area, it is unlikely to easily cause the transfer sheet S to be pulled back toward the pair of registration rollers 24, which can prevent image shift.

Further in the configuration of the image forming apparatus 1 according to this exemplary embodiment of the present invention, the leading edge of the transfer sheet contacts a surface of the photoconductor 11B before entering the primary transfer nip contact area. This configuration can fill the gap formed between the transfer sheet S and the photoconductor 11B at the entrance of the primary transfer nip contact area, and can achieve better transferability.

Further, as previously described, the image forming apparatus 1 according to an exemplary embodiment of the present invention includes the photosensors 41 and 42 that serve as detectors on the sheet conveyance route. Results of detection by the photosensor 41 can be used to determine whether the trailing edge of the transfer sheet S has passed the point of force application. When the results indicate that the trailing edge of the transfer sheet S has passed the point of force application, the contact/separation mechanism 50 may move or return the pair of registration rollers 24 to the active state so that the pair of registration rollers 24 can apply the conveyance force to the transfer sheet S. In this case, preparation for conveying a transfer sheet for a subsequent image forming operation can be conducted expeditiously, thereby speeding up the following print job. If a detector for detecting whether the trailing edge of the transfer sheet S has passed the point of force application is disposed close to and downstream from the pair of registration rollers 24 in a direction of conveyance of the transfer sheet S, the detection results indicating that the trailing edge of the transfer sheet S has passed the point of force application can be more secured.

Further in this exemplary embodiment of the present invention, the image forming apparatus 1 according to an exemplary embodiment of the present invention includes the photosensors 41 and 42 as jam detectors. When the photosensors 41 and 42 detect a paper jam, the contact/separation mechanism 50 deactivates the pair of registration rollers 24. This action can facilitate a sheet removal operation even when a transfer sheet is jammed at the registration point.

In this exemplary embodiment of the present invention, the image forming unit 12B for forming black toner image is illustrated as employing a direct transfer method to transfer the image directly onto the transfer sheet S and the image forming units 12Y, 12C, and 12M for forming yellow, cyan, and magenta toner images are illustrated as employing an indirect transfer method or an intermediate transfer method to transfer the composite image onto the intermediate transfer belt 6 before transferring the four-color image onto the transfer sheet S. However, an exemplary embodiment of the present invention is not intended to be limited to the above-described configuration or transfer method. For example, an exemplary embodiment of the present invention can be widely applied to a configuration in which a color image is transferred onto a transfer sheet after the transfer sheet has entered a primary transfer nip contact area.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

at least one image carrier to carry an image on a surface thereof;

a recording medium conveyor disposed at least partly facing a first image carrier of the at least one image carrier to form a transfer nip therebetween, at least one of the first image carrier and the recording medium conveyor conveying a recording medium in the transfer nip for transferring the image formed on the surface of the at least one image carrier onto the recording medium thereat;

a conveyance member disposed closest to the transfer nip on an upstream side of the transfer nip in a direction of conveyance of the recording medium to provide a conveyance force to convey the recording medium to the transfer nip; and a conveyance control mechanism located proximal to the conveyance member to control movement of the conveyance member, the conveyance control mechanism shifting the conveyance member to an inactive state to deactivate the conveyance member so that the conveyance member stops providing the conveyance force to move the recording medium after a leading edge of the recording medium has entered the transfer nip and before a trailing edge of the recording medium passes a point of force application where the conveyance member applies the conveyance force to the recording medium, the conveyance member remaining in the inactive state until the recording medium passes the point of force application, the conveyance force remaining unapplied to the recording medium at an upstream side of the conveyance member in the direction of conveyance of the recording medium from when the conveyance control mechanism deactivates the conveyance member to when the trailing edge of the recording medium passes the transfer nip, the image forming apparatus further comprising:

a first image forming part located downstream from the conveyance member and comprising the first image carrier of the at least one image carrier and the recording medium conveyor, the first image forming part forming a single color image to be transferred onto the recording medium at a first transfer nip formed between the first image carrier and the recording medium conveyor while providing the conveyance force to the recording medium;

an intermediate transfer member held in contact with the recording medium conveyor to transfer an image onto the recording medium; and a second image forming part disposed downstream from the conveyance member and comprising multiple second image carriers other than the first image carrier of the at least one image carrier, the second image forming part forming a composite color image on the intermediate transfer member to be transferred onto the recording medium at a second transfer nip formed between the intermediate transfer member and one of the recording medium conveyor and a transfer member other than the recording medium conveyor while providing the conveyance force to the recording medium, the conveyance control mechanism shifting the conveyance member to the inactive state to deactivate the conveyance member so that the conveyance member stops providing the conveyance force to move the recording medium after the leading edge of the recording medium has entered the further-upstream of the first transfer nip and the second transfer nip in the direction of conveyance of the recording medium and before the trailing edge of the recording medium passes the point of force application.

2. The image forming apparatus according to claim 1, wherein the conveyance control mechanism deactivates the conveyance member when a margin provided on the leading edge of the recording medium reaches the transfer nip.

3. The image forming apparatus according to claim 1, wherein the conveyance member comprises two rotary members at least one of which is driven to rotate, and applies the conveyance force to the recording medium by holding the recording medium between the two rotary members, the conveyance control mechanism deactivating the conveyance member by separating the two rotary members from each other.

4. The image forming apparatus according to claim 1, wherein the recording medium conveyor corresponds to an electrostatic conveyance belt member to convey the recording medium by electrostatically attracting at least one surface of the recording medium to a surface of the electrostatic conveyance belt member on at least one of an upstream side and a downstream side from the transfer nip in a direction of conveyance of the recording medium.

5. The image forming apparatus according to claim 1, wherein the conveyance member conveys the recording medium in a substantially vertically upward direction toward the transfer nip.

6. The image forming apparatus according to claim 1, wherein the conveyance control mechanism shifts the conveyance member to the inactive state to deactivate the conveyance member after the leading edge of the recording medium has entered the further-downstream of the first transfer nip and the second transfer nip in the direction of conveyance of the recording medium.

7. The image forming apparatus according to claim 1, wherein the conveyance control mechanism shifts the conveyance member to the inactive state to deactivate the conveyance member before the leading edge of the recording medium enters the further-downstream of the first transfer nip and the second transfer nip in the direction of conveyance of the recording medium.

8. The image forming apparatus according to claim 1, wherein an average linear velocity of a part of the recording medium to which the conveyance member applies the conveyance force is faster than a linear velocity of the image carrier by approximately 0.1% to approximately 2.0%.

9. The image forming apparatus according to claim 1, wherein the leading edge of the recording medium contacts a surface of the image carrier before entering the transfer nip.

10. The image forming apparatus according to claim 1, further comprising a detector to detect whether the trailing edge of the recording medium has passed the point of force application, the conveyance control mechanism returning the conveyance member to an active state to apply the conveyance force to the recording medium when the detector detects the trailing edge of the recording medium has passed the point of force application.

11. The image forming apparatus according to claim 1, further comprising a jam detector to detect a paper jam, the conveyance control mechanism deactivating the conveyance member when the jam detector detects a paper jam.

12. The image forming apparatus according to claim 1, wherein:

the conveyance member includes a pair of registration rollers which directly contact each other when the recording medium is not therebetween.

13. The image forming apparatus according to claim 1, wherein:

the at least one image carrier is a photoconductive drum which forms the transfer nip with the recording medium conveyor.

14. The image forming apparatus according to claim 1, wherein:

the recording medium conveyor is a belt.

15. The image forming apparatus according to claim 1, further comprising:

a developer system which forms a toner image using three toner colors, none of which is black;

a belt to carry the toner image of the three colors; and a developer system which forms a toner image using only a black color on the at least one image carrier which is a photoconductive drum, wherein the photoconductive drum and the belt to carry the toner image of the three colors are arranged such that the toner image of the black color is first transferred onto the recording medium, and the toner image of the three toner colors is subsequently transferred onto the recording medium which has the toner image of the black color thereon.

* * * * *